US009644638B2

(12) United States Patent
Kushnarev et al.

(10) Patent No.: US 9,644,638 B2
(45) Date of Patent: May 9, 2017

(54) MAINLINE ELECTRIC OIL PUMP ASSEMBLY AND METHOD FOR ASSEMBLING SAME

(71) Applicant: LIMITED LIABILITY COMPANY NEFTEKAMSK MACHINERY PLANT, Neftekamsk (RU)

(72) Inventors: Vladimir Ivanovich Kushnarev, Moscow (RU); Yury Sergeevich Oboznyi, Sumy (UA); Oleg Anatolievich Ryakhovsky, Moscow (RU); Aleksandr Mikhailovich Guskov, Moscow (RU); Aleksei Igorevich Petrov, Moscow (RU)

(73) Assignee: Limited Liability Company Neftekamsk Machinery Plant, Neftekamsk (RU)

( * ) Notice: Subject to any disclaimer, the term of this patent is extended or adjusted under 35 U.S.C. 154(b) by 372 days.

(21) Appl. No.: 14/361,559

(22) PCT Filed: Dec. 5, 2012

(86) PCT No.: PCT/RU2012/001025
§ 371 (c)(1),
(2) Date: May 29, 2014

(87) PCT Pub. No.: WO2013/085433
PCT Pub. Date: Jun. 13, 2013

(65) Prior Publication Data

US 2014/0328706 A1 Nov. 6, 2014

(30) Foreign Application Priority Data

Dec. 9, 2011 (RU) ..... 2011150131

(51) Int. Cl.
*F04B 35/04* (2006.01)
*F04D 29/42* (2006.01)
(Continued)

(52) U.S. Cl.
CPC ..... *F04D 29/426* (2013.01); *F04D 1/006* (2013.01); *F04D 29/049* (2013.01);
(Continued)

(58) Field of Classification Search
None
See application file for complete search history.

(56) References Cited

U.S. PATENT DOCUMENTS 3,168,338 A * 2/1965 Spieth ..... B23B 31/1177 24/135 R
3,466,724 A * 9/1969 Hosea, Sr. ..... B05D 7/14 264/134
(Continued)

FOREIGN PATENT DOCUMENTS

GB 1 255 169 12/1971
RU 2 246 047 C2 12/2003
(Continued)

OTHER PUBLICATIONS

PCT International Search Report, issued in International Application No. PCT/RU2012/001025 dated Feb. 21, 2013.

*Primary Examiner* — Charles Freay
(74) *Attorney, Agent, or Firm* — Finnegan, Henderson, Farabow, Garrett & Dunner LLP

(57) ABSTRACT

The mainline electric oil pump assembly relates to the field of assemblies for pumping oil in main oil pipelines. The aim of the present invention is to create a mainline electric oil pump assembly with improved technical and economic characteristics, reduced noise and vibrations, and increased reliability, service life and performance. The main distin-
(Continued)

guishing features of the proposed assembly which contribute to the achievement of the aforementioned aim are: the non-splined, zero-backlash seating of the impeller on a smooth shaft, the use of roller bearings seated in a non-splined, zero-backlash fashion on the smooth shaft, the use of mechanical seals seated in a non-splined, zero-backlash fashion on the smooth shaft, the use of self-correcting adjustable spherical supports under the supporting feet of the pump, and the boring of the seating surfaces of the pump housing for the rotor in a single set-up operation.

2 Claims, 9 Drawing Sheets

(51) Int. Cl.

| | |
|---|---|
| ***F04D 1/00*** | (2006.01) |
| ***F04D 29/049*** | (2006.01) |
| ***F04D 29/60*** | (2006.01) |
| ***F04D 29/046*** | (2006.01) |
| ***F04D 29/62*** | (2006.01) |
| ***F04D 29/66*** | (2006.01) |
| ***F04D 29/20*** | (2006.01) |
| *F04D 13/02* | (2006.01) |

(52) U.S. Cl.
CPC ..... *F04D 29/0462* (2013.01); *F04D 29/20* (2013.01); *F04D 29/605* (2013.01); *F04D 29/622* (2013.01); *F04D 29/628* (2013.01); *F04D 29/669* (2013.01); *F04D 13/021* (2013.01); *Y10T 29/49236* (2015.01)

(56) References Cited

U.S. PATENT DOCUMENTS

| | | | | | |
|---|---|---|---|---|---|
| 3,627,339 | A * | 12/1971 | Burweger | F16C 23/045 | 248/182.1 |
| 3,764,236 | A * | 10/1973 | Carter | F04D 1/06 | 415/104 |
| 3,995,967 | A * | 12/1976 | Haller | F16B 21/20 | 279/2.17 |
| 4,031,844 | A * | 6/1977 | Onal | B63H 11/08 | 415/204 |
| 4,563,124 | A * | 1/1986 | Eskew | F04D 29/628 | 415/102 |
| 4,722,149 | A * | 2/1988 | Weaver | F04D 29/669 | 415/1 |
| 5,069,654 | A * | 12/1991 | Rampe | F16D 1/0805 | 29/892 |
| 5,184,927 | A * | 2/1993 | Judy | B23C 3/30 | 409/143 |
| 5,292,213 | A * | 3/1994 | Massa | B23B 31/006 | 279/129 |
| 6,048,168 | A * | 4/2000 | Sabini | F04D 29/0465 | 415/102 |
| 7,871,239 | B2 * | 1/2011 | Sorokes | F04D 17/125 | 415/116 |
| 2010/0098531 | A1 | 4/2010 | Towsley et al. | | |

FOREIGN PATENT DOCUMENTS

| | | | |
|---|---|---|---|
| RU | 2 263 247 | C2 | 4/2005 |
| RU | 95043 | U1 | 6/2010 |
| RU | 103 584 | U1 | 4/2011 |
| RU | 106680 | U1 | 7/2011 |
| SU | 1838686 | A3 | 8/1993 |
| UA | 22 403 | U | 4/2007 |
| WO | WO 2010/030802 | A2 | 3/2010 |

* cited by examiner

MAINLINE ELECTRIC OIL PUMP ASSEMBLY AND METHOD FOR ASSEMBLING SAME

This application is a national stage filing under 35 U.S.C. §371 of international Application No. PCT/RU2012/001025, filed on Dec. 5, 2012, which claims priority to Russian Patent Application No. 2011150131, filed on Dec. 9, 2011. The contents of this application is incorporated herein by reference.

TECHNICAL FIELD

The mainline electric oil pump assembly relates to the field of assemblies for pumping oil in main oil pipelines.

BACKGROUND

There has been known a shock-absorbing base frame of a pump assembly (RU Patent 103584, IPC F04D29/00, publ. Apr. 20, 2011, the patent owner—OOO "NKMZ"), comprising self-correcting adjustable mounting means (or in more correct terminology—mounting supports). However, as it describes a base frame of pump assembly rather than the electrical pump assembly as a whole, comprising a single-stage double-volute centrifugal pump, an electric drive motor, the shafts of which are coupled by a coupling, and a base (or mounting) frame having supports mounted under the feet of a pump and/or a motor, a number of features of the interaction of all of the major components of the assembly were not considered.

There has been known a centrifugal electric pump assembly, comprising a pump and a motor mounted on a common foundation base and coupled by a coupling (RU Patent 95043, IPC F04D1/00, F16D3/50, publ. Jun. 10, 2010). It is argued that the technical effect is to reduce wear of bearings, motor overheating, noise and vibration.

However, this assembly relates to the nuclear industry, and therefore does not take into account the characteristics of mainline electric oil pump assemblies. Furthermore, this patent 2.5 focuses on the specific problem of improving the design of a flexible coupling between the pump and motor shafts. A flexible coupling for centrifugal pump unit has been specifically described in RU Patent 2246047 (IPC F04D29/62, publ. Feb. 10, 2005), however, the disadvantages of this coupling include relatively low operational reliability, ageing and thermal ageing of rubber flexible elements with change of the elasticity coefficient of rubber under large variations in temperature, especially in the presence of oil vapours and possible contact with oil when using the coupling in mainline centrifugal oil pump.

As for the pump being the most important and challenging component of the mainline electric oil pump assembly, there has been known a double-volute centrifugal pump for pumping oil of JSC Sumskoy plant "Nasosenergomash" (Patent of Ukraine 22403, IPC F04D 1/00, publ. Apr. 24, 2007). The pump comprises a housing within which the rotor is mounted, on whose shaft bearings, mechanical seals and an impeller, which together with the inlet volume and expanding volute of the housing constituting a flow area are fixed. The housing is further installed with a circulation system of lubrication and cooling of inner cavity of mechanical seals, and the impeller mounted to a shaft is split in two halves. The presence of the two halves of the impeller enables to double reduce the vibration characteristics of the pump by mounting the halves of the impeller to the shaft of the rotor with the rotation of one half relative to the other about the axis of the rotor on the half angle between the blades. Rotation of the halves is provided by a suitable arrangement of the key grooves. A disadvantage of this pump is presence of keys and key grooves, which weaken the shaft of the rotor and are being stress concentrators, given the fundamental presence of the backlashes in keyed connections, the presence of key grooves on the shaft facilitating excitation of vibrations of the pump rotor.

There has been also known almost the same double-volute centrifugal pump for pumping oil of the same patent holder—JSC Sumskoy plant "Nasosenergomash" (together with JSC "VNIIAEN" (Sumy, Ukraine)) (RU Patent 106680, IPC F04D1/00, F04D29/00, publ. Jul. 20, 2011). The disadvantage of this pump are gaps in the bearing sliding supports that causes dynamic beats in the gaps that contribute to increased vibration and noise of the pump.

Regarding the analogue method for assembling the frame-mounted pump assembly by means of its high-efficiency assembly, casting, machining and polishing (or grinding) there has been known a published international PCT application WO2010030802 (IPC F04D 17/02, publ. Mar. 18, 2010) for a method of assembly of a high-efficiency three-stage horizontal centrifugal pump as a part of an electric pump assembly. However, this method is still not designed for the assembly of the mainline electric oil pump assembly and therefore does not take into account many of design features of such assembly.

Also there has been known a method of manufacturing a horizontal pedestal-mounted (analogue of a base frame) pump assembly described in UK Patent 1255169 (IPC F04C19/00, publ. Dec. 1, 1971) using machining of several pump surfaces for subsequent critical connections during a single set-up. However, the described pump is not a mainline oil pump type and therefore this method of manufacturing is not designed for the assembly of the mainline electric oil pump assembly and therefore does not take into account many of the design features of such assembly.

As an analogue of method for high-efficiency frame-mounted assembling has been known a method for assembling a horizontally oriented turbo compressor unit (RU Patent 2263247, IPC F16M5/00, F16M9/00, F01D25/28, publ. Oct. 27, 2005), consisting of a turbo compressor group (functional analogue of a pump) and a charger (a functional analogue of a motor), and their frames (mounting and transport and technological ones) with support surfaces.

The disadvantages of this method include the use of complex and time-consuming methods of assembling and installation of the unit on the frames and the use of spacer shims (or plates with measured thickness) with a number of important limitations to use.

SUMMARY OF THE INVENTION

The main overall aim of the present invention is to create a mainline electric oil pump assembly with improved technical and economic characteristics, in particular, with reduced noise and vibrations, increased reliability, service life and performance through a set of design and technological improvements in all core components of the assembly integrated by a single inventive concept.

Technical effect of improved construction of the assembly is achieved by that in part of improvements of basic components integrated by a single inventive concept, the mainline electric pump assembly comprises a mainline horizontal single-stage double-volute pump, an electric drive motor, a coupling, connecting their shafts, and a common or separated frames for mounting the pump and motor thereon, the said pump comprising a housing with two semi-volute inlets and a double-volute outlet and the housing cover, a rotor consisting of a shaft and an impeller being installed between a housing and a cover, the said impeller being seated on the shaft by way of a double-sided collet clamping device having taper sleeves and screws, rotor mechanical seals being seated on the shaft by way of single-sided collet clamping devices having taper sleeves and screws, the said collet clamping devices being a combination of two coaxial rings with tapered working surfaces with rings being slidable by using clamping screws along the axis of the shaft relative to each other to clamp the shaft. The pump rotor is mounted in external relative to the pump housing console supports of roller bearings of two types: double-row spherical roller bearing taking up axial load of the pump shaft, and the floating toroidal roller bearing, both bearings being mounted on the shaft on tapered adapter sleeves in axial section, all connections of the housing being fastened in pairs including removable tapered pins with threaded ends. For safe sealing of bearing assemblies screw seals may be used. Furthermore, to reduce bearing stress concentration, the generant of the inner cylindrical surface of the inner ring of the clamping device in areas near the ends is second ordered curved, on the end faces of all high strength steel alloyed taper sleeves: collet clamping devices and clamping sleeves these ends can be micron-accurate smoothed.

The pump housing has side twin semi-volute inlets of double-volute of the pump consisting of an inlet, a volute and a confuser area in front of the entrance of the flow in the impeller, and characterized by the reference and intermediate cross sections of the inlet volute part, an angle of contact of inlet volute part and the presence of the tongue of the volute separating the liquid flows going through the volute part and the inlet. The improved inlets have reference and intermediate cross sections of volute part reduced by 15 . . . 20% of flow efficiency, angle of contact of inlet volute part increased up to 200 . . . 210° and the tongue of modified shape gradually tapered from the periphery to the center.

The pump and the motor of electric pump assembly are installed in substantially zero-backlash fashion by their feet via the mounting supports on the common or separated frames: fixing the pump and the motor to a common or separated frames is made using the highly precise height-adjustable and angle self-correcting mounting supports, the mounting surfaces of the pump feet are raised to the level of a common central axis of the suction and discharge nozzles of the pump, a compensating dual coupling having flexible discs is being also used, the said highly precise mounting support consisting of three gaskets, two lower gaskets are being connected by a thread allowing changing the height of mounted support, middle and upper gaskets having interfacing spherical surfaces with the same radius of curvature, all of the said gaskets having a common axial hole for the mounting bolt and nut for the final clamping of feet to the frame by bolt and nut through the common through hole, two lower gaskets having blind radial holes to enable using leverage when adjusting the height of the support.

The coupling connecting the motor and the pump shaft is a compensating dual disc coupling and consists of a combination of two identical couplings connected by an intermediate hollow shaft, each coupling having flexible hardened steel disc (or a set (pack) of discs) mounted between its two half coupling, to remove the discs in the couplings there are roller joints installed in the form of spherical double-row roller bearings, each of the two couplings having the save even number of clamping fixtures of set of discs, opposite directed sleeves of the fixtures are disposed on the flanges of half couplings next but one, uniformly and on a same radial distance from the common central axis of rotation of coupling and shafts, wherein the oppositely directed clamping fixtures of flexible discs of both couplings are coaxial.

A technical effect of the method for assembling the pump assembly is achieved by high precision and virtually zero-backlash technology process of assembling using the base components consisting of a sequence of the following techniques: first, assembling the pump, and then assembling the entire pump assembly. Before assembling the pump, in the cast pump housing and cast housing cover seating surfaces of feet of the pump housing and the parting planes—a common horizontal plane of the housing and the cover and vertical mating planes around the rotor shaft holes, are basically polished to install housings of bearing assemblies. To bore holes for adjusting rings of the rotor axial clearance in the housing, gap seal holes of the impeller and bearing holes in the bearing assembly housings between the pump housing and the pump cover and through the empty bearing assembly housings on a boring machine in a single set-up operation, a boring bar with regulated overhang boring tools is preset, then the pump housing and the cover are coupled by pins and two removable taper pins with threaded ends on the horizontal plane of their parting, and empty bearing assembly housings are coupled by screws and pairs of removable taper pins with threaded ends on the vertical parting planes with the pump housing and the housing cover. After boring of the holes in a single set-up all bases and covers are disconnected removing all removable taper pins. Regardless of the boring operation in a single set-up the pump rotor is assembled of the shaft, the impeller and the two shaped sleeves on the shaft involved in the formation of a pump flow area, using double-sided collet clamping devices with taper sleeves and screws and using tool in a form of a tube of accurate dimensional length for accurate positioning of the impeller on the shaft, then shaped sleeves on both sides of the collet clamping device are installed and fixed. Then rotor is mounted with axial clearance spacer rings being preliminary mounted on its shaft in the pump housing without cover, and the gaps between the impeller and the rings with shaft axial locking relative to the pump housing are aligned, e.g. by temporary spacers. Regardless of the rotor mounting in the pump housing two bearing assemblies with a double-row spherical roller bearing taking up axial load, and a toroidal roller bearing, being a floating one, and therefore not taking up axial load, are separately assembled. Then adjustment assembling is done, followed by disassembling of the bearing assembly with a double-row spherical roller bearing on the rotor shaft and the pump housing to provide substantial zero-backlash between the mating planes of the bearing assembly base and the pump housing at the expense of a corresponding decrease in the thickness of the compensatory ring. Prior to the final mounting of the pump cover to the pump housing with pins and taper pins temporary spacers are removed from the shaft axial gaps relative to the housing. After mounting of the pump cover to the pump housing mechanical seals between the rotor shaft and assembled pump housing are assembled, mechanical seals are fixed on the housing, for example, with pins, and on the shaft with a zero backlash single-ended collet clamping device with taper sleeve and screws. At the end of the pump assembling, bearing assemblies are finally set on assembled pump housing by using taper clamping sleeves between the bearings and the shaft, and the radial clearance between the impeller and the pump housing, including gap seals, is set by reusing removable taper pins between the bearing assemblies bases and the pump housing.

The connection of the pump cover and the pump housing is preferably securely and zero backlash compacted or hermetically sealed with liquid gasket (anaerobic sealant), with the expectation of the end of cured sealant. The sealant cures in the absence of air between zero-backlash metal surfaces by compressed forces of tightening pins. Source liquid monomer is transformed into the polymer sealant caused by the compression force but without the air for 1 . . . 2 days and then securely holds the joint seal in the operating conditions of high differential pressures.

Then follows the assembling of the electric pump assembly, comprising mounting of the pump and electric motor to a common or separate frames on a foundation, connection (usually welding) of pipes to flanges of the pump nozzles, adjustment of the alignment of the pump and electric motor shafts, and the final coupling of the pump and electric motor shafts via a coupling. Mounting of the pump and the electric motor to a common or separate frames with fasteners to the frame is preferably carried out using adjustable highly-precise mounting supports and typically includes the following sequence of techniques: mounting of a common frame or individual frames to a foundation, horizontal levelling of support surfaces at two levels, and finally mounting the frames to the foundation; fitting mounting of the pump and/or electric motor to the frame or individual frames on mounting supports; producing general through holes in the supports, feet and the corresponding mounting surfaces of the frame and presetting of mounting bolts in produced through holes, welded or flanged connection of pump nozzles with pipelines; adjustment and final installation of all mounting supports under the pump and the electric motor, simultaneously using laser for precise alignment of the pump and electric motor shafts; final tightening of the mounting bolts of supports; connection of the pump and electric motor shafts exhibited coaxially aligned and spaced apart from each other by installing a compensating dual disc coupling with the intermediate shaft.

DESCRIPTION OF EMBODIMENT

Figure 1:
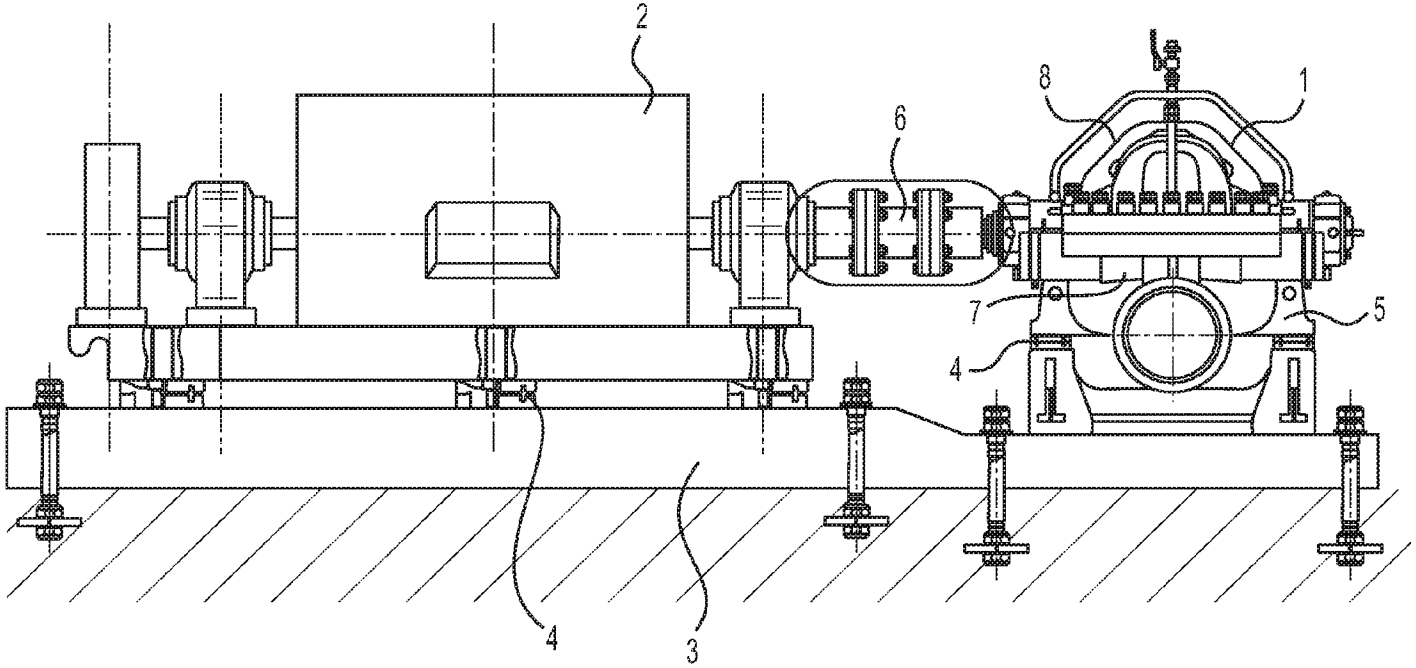
FIG. 1 is a general view of electric pump assembly.
Figure 2:
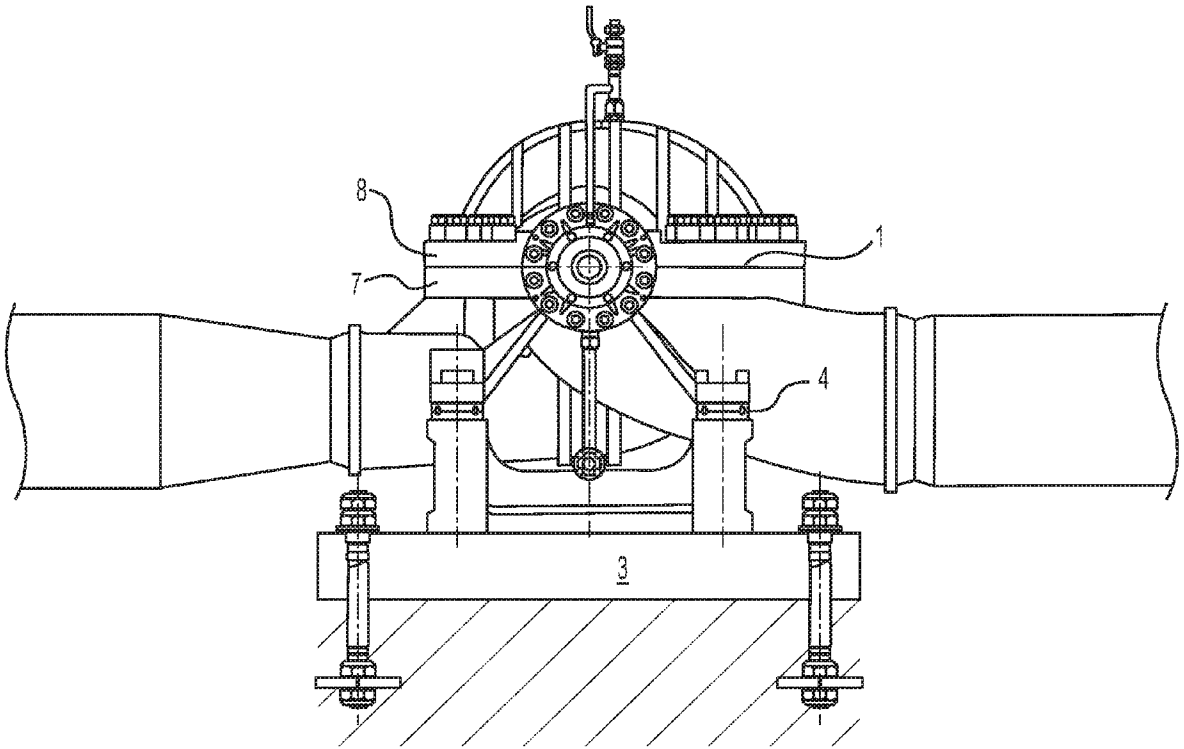
FIG. 2 is a view of a pump with connected pipelines.
Figure 3:
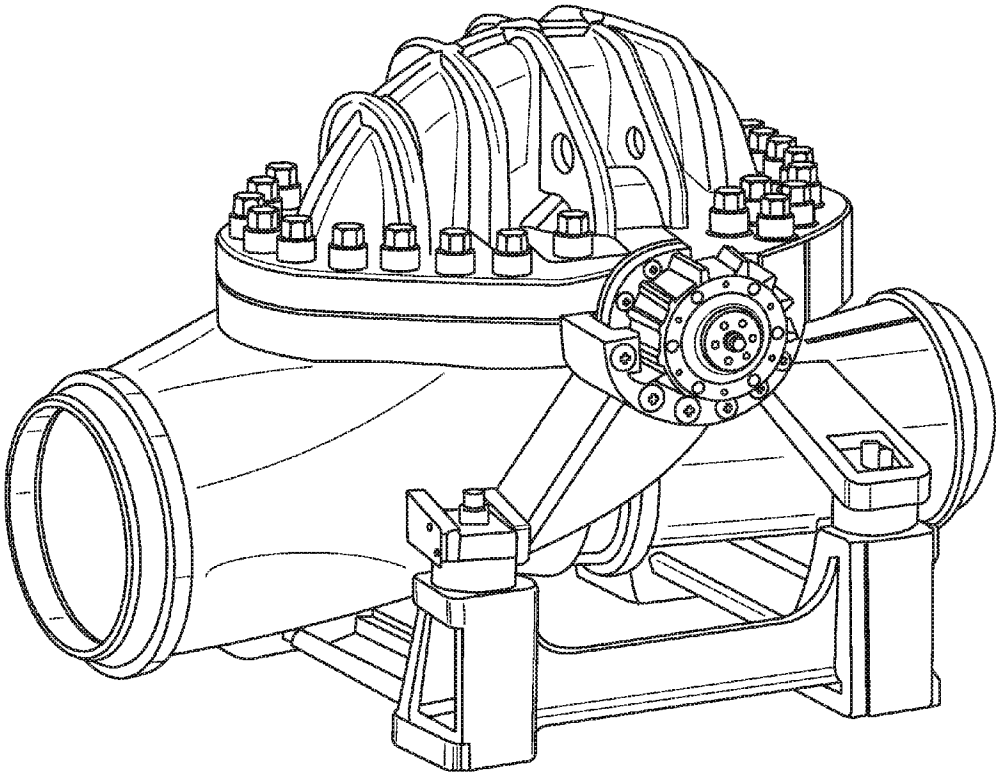
FIG. 3 is a perspective view of upgraded mainline oil pump.
Figure 4:
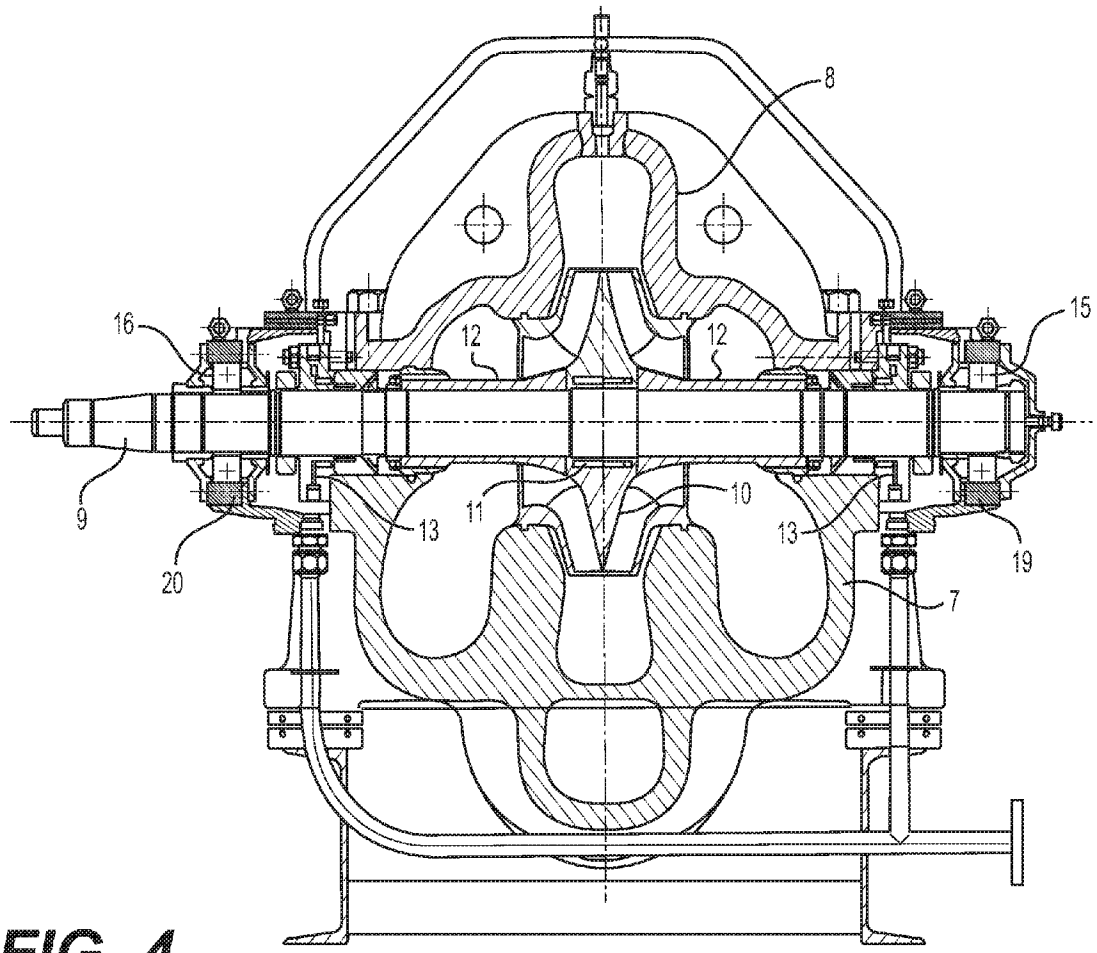
FIG. 4 is a general side cross-sectional view of a pump.
Figure 6:
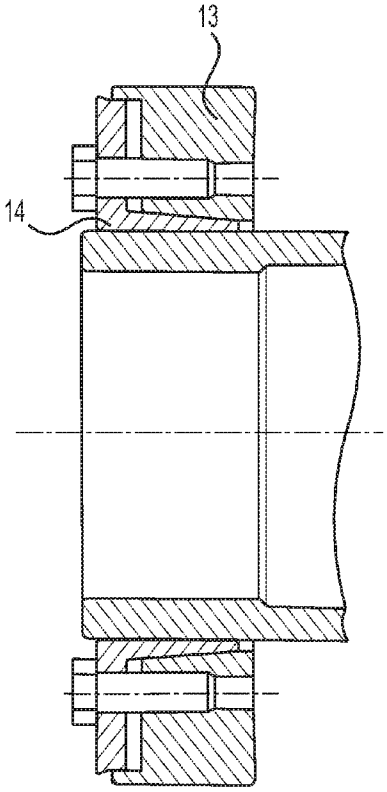
FIG. 6 is a gap-free single-sided clamping device of one of the two mechanical seals of the shaft.
Figure 5:
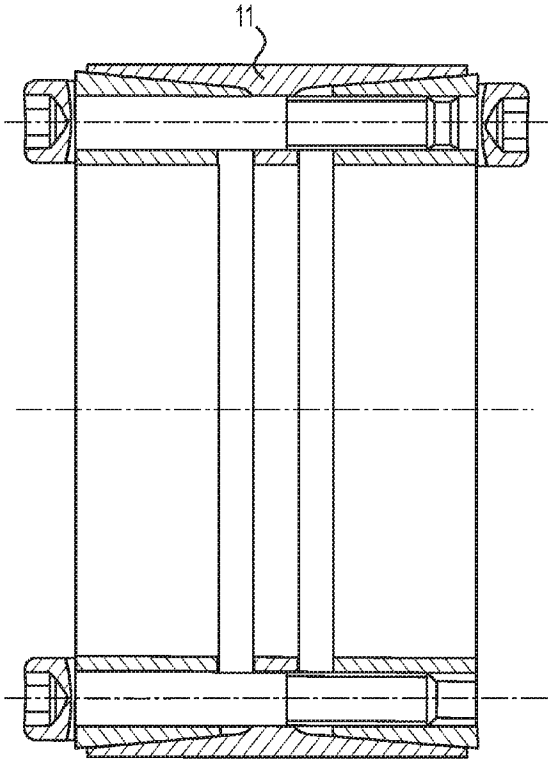
FIG. 5 is a gap-free double-sided clamping device for mounting impeller to a shaft.
Figure 8:
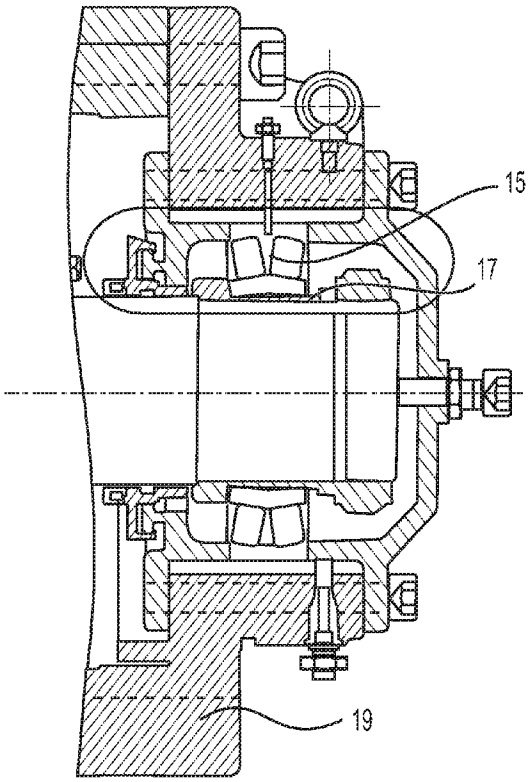
FIG. 8 is a bearing support (assembly) of the pump rotor with a double-row spherical roller bearing.
Figure 7:
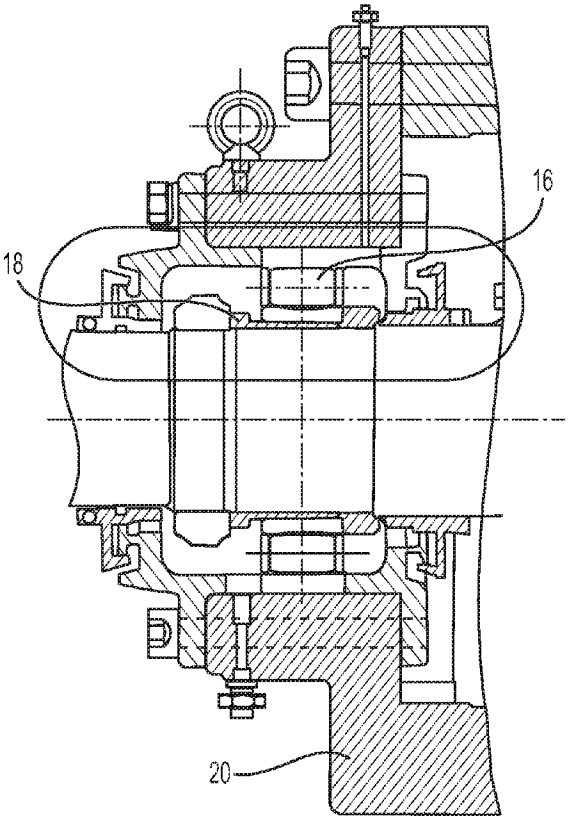
FIG. 7 is a bearing support (assembly) of the pump rotor with a toroidal roller bearing.
Figure 9:
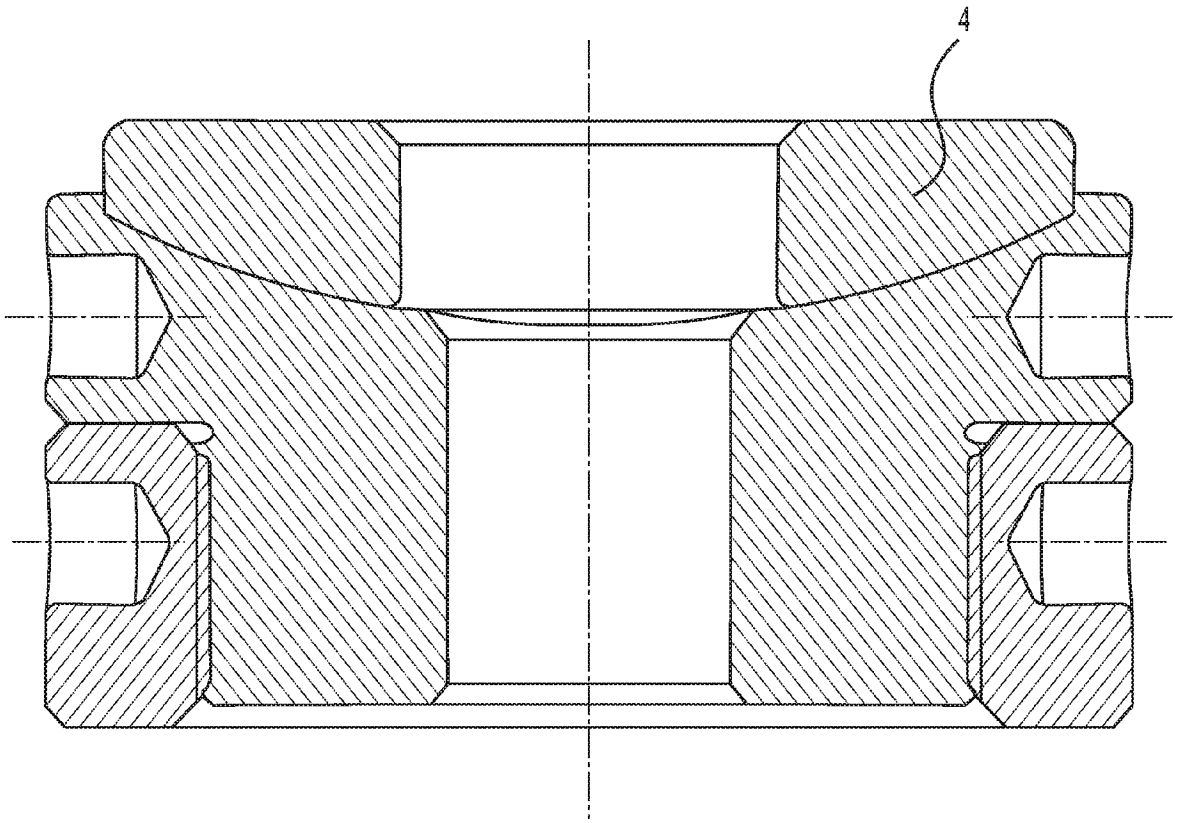
FIG. 9 is a mounting support under the pump foot and electric drive motor in a scaled-up side sectional view.
Figure 10:
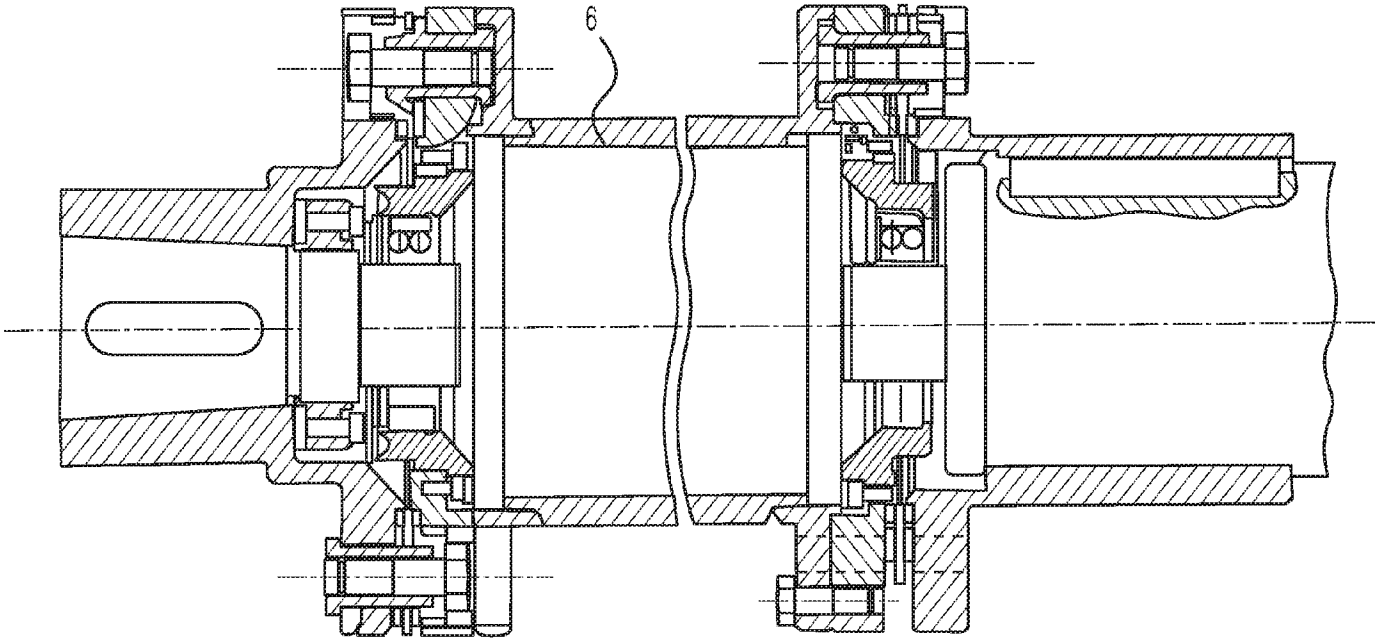
FIG. 10 is a general longitudinal cross-section of compensating dual disc coupling between the pump shafts and the electric drive motor.
Figure 11:
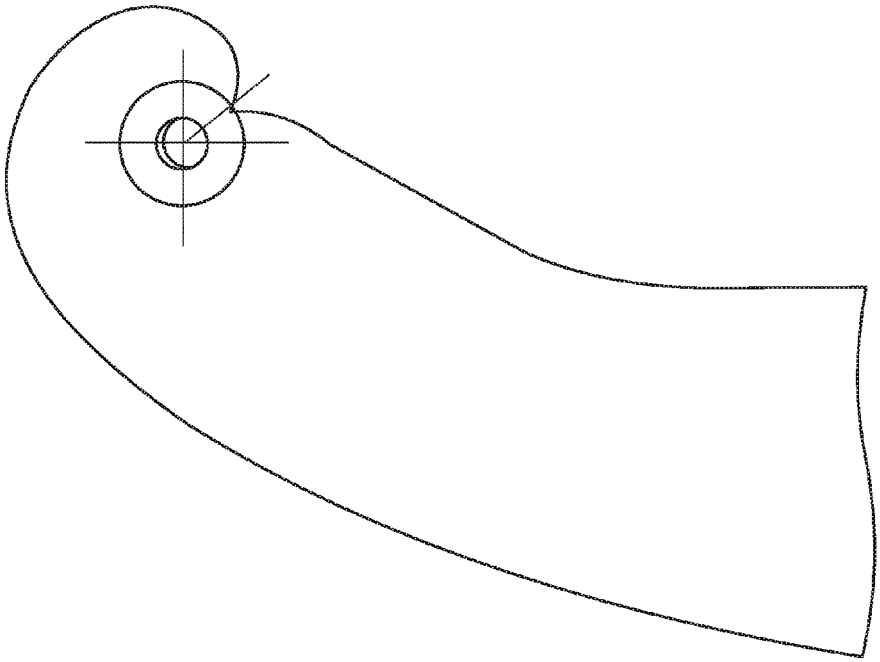
FIG. 11 is a scheme of modified semi-volute pump inlet.

In the figures in total numbering of the positions are marked the following significant components and parts in large scale. The most significant components and parts of electric pump assembly are: a horizontal single-stage double-volute pump 1, an electric drive motor 2, a frame 3, mounting supports 4 under the feet 5 of a pump and a motor, and a coupling 6. The most significant components and parts of a pump: a cast housing 7 with two semi-volute inlets and a double-volute outlet and a cast cover 8 of the pump housing (with a common horizontal plane of the parting on the common central plane of symmetry of the holes for the pump rotor), a pump rotor consisting of balanced and machined shaft 9 and impeller 10, a double-sided collet clamping device 11 of the impeller on the shaft, two shaped sleeves 12 on the shaft to form the flow part of the pump, mechanical seals 13, single-sided collet clamping devices 14 on the shaft, two different roller bearings: double-row spherical roller bearing 15 and toroidal roller bearing 16, taper fastening sleeves 17, 18 for bearings 19, 20, tube-type bearing housings (console supports), bearing lubrication and sealing system, sets of fasteners (screws, bolts, nuts, pins, removable taper pins with threaded ends).

To ensure a firm zero-backlash connection of the impeller and a shaft, a clamping element consisting of three major parts: a central ring into which identical side rings are drawn by the force of screw tightening, wherein the taper surfaces of the rings are pressed against the tapered surfaces of the ring, is used. The central ring and the side rings come into contact by taper surfaces. The connection is self-centering relative to the axis of rotation and is being an easily mounted pressure connection. The connection transmits considerable torque and axial forces.

To secure the connection of the bearing housings, a taper ratio of removable taper pins is small, usually 1:50. To remove the pin its threaded end is used.

Taper clamping sleeves of bearings are equipped with axial section to increase the flexibility of the sleeve body.

The frame of the assembly is preferably manufactured of channels, under the engineering empirical recommendations the channel size is approximately 0.1 of the maximum overall size of the frame.

Factors affecting the characteristics of a conventional assembly, primarily parameters of its vibration and noise are the following:

- mechanical: rotor imbalance; shaft length of the rotor, its profile with key grooves and keyed connection with gaps; bearing supports; pump shaft and drive motor misalignment; the degree of non-rigid fixing of the assembly to the frame;
- hydrodynamic: blade vibration and off-design (unrated) operation of the pump.

The main technical design solutions that improve the performance of the referred characteristics of the pump assembly reducing in the first place vibration and noise of the pump assembly are:

- the use of non-splined zero-backlash seating of the impeller on a smooth shaft,
- the use of tailored roller bearings seated in a non-splined and zero-backlash fashion on a smooth shaft,
- the use of mechanical seals seated in a non-splined and zero-backlash fashion on a smooth shaft;
- the use of self-correcting height-adjustable spherical mounting supports under the feet of the pump and motor;

and the main technological solution: in the process of assembling the pump: boring of the seating surfaces of the pump housing for the rotor in a single set-up operation.

The main advantage of using collet clamping devices with taper sleeves and screws is a complete replacement of splined connections, and thus removing the source of dangerous stress concentrators of rotor shaft that is guaranteed to have impact on reducing the vibration activity and increasing the resource of the pump rotor and the pump assembly as a whole. Collet clamping device has no backlash, does not damage the surface of the shaft and the hub, easily installed and removed of the clamping connection.

The main advantage of the use of tailored roller bearings, allowing floating the rotor shaft without bending (toroidal roller bearing) and easily perceiving changes of the length of the shaft caused by thermal displacements (double-row spherical roller bearing) is the possibility of significant shortening (15-20%) of the length of the shaft with bearings with increasing rigidity and a corresponding decrease in its vibration activity. In addition, the tubular bearing housings instead of demountable semi-tubular bearing housings also improve the stiffness characteristics of the pump.

Detailed Assembling of the Pump

Before assembling the pump, perform boring of holes with a boring bar on a boring machine in the housings in a single set-up operation (when boring of the said holes the empty hearing housings must be secured on the pump housing by screws and fixed by the pairs of removable taper pins).

Next, connect the rotor shaft and impeller by double-sided collet clamping connection with taper sleeves and screws. Secure position of the impeller relative to the shaft through a tool in the form of a tube with precise measuring length with disc and screw holes at the end. When installing the impeller, put the tube on the shaft all the way until the disc stops at the end of the shaft and through the hole in the disc attach it to the end of the shaft by screw. Tighten the screws of the collet connection in three bypass tightening torque 0.3T, 0.7T and T.

Set dummy screws to connect the impeller with a shaped sleeve on the side opposite main screws of collet connection.

Set the shaped sleeves on both sides of the impeller, secure them with nuts and lock nuts.

Lower the shaft with pre-installed rings (centering rings) into the pump housing and install the rings in the grooves of the housing.

By displacing the shaft along the axis achieve gap equality between the impeller and the rings, insert temporary spacers (gauges) into these gaps for axial fixation of the shaft relative to the pump housing.

Separately, on mounting table assemble two bearing assemblies. When assembling the bearing assembly with a double-row spherical roller bearing insert the bearing into the bearing housing and fix it by dummy cap. Similarly, assemble another bearing assembly with a toroidal roller bearing.

On both sides of rotor shaft install machine seals, brass seal sleeves (they may be sealed with a screw) and compensating rings (not shown in the figures).

Install the bearing assembly on the shaft, insert a taper sleeve into the bearing (from the bearing kit) and secure with a nut. Install the screws to connect the bearing housing to the pump housing. Screwing up the said screws by hand and using the mounting gaskets ensure that mating planes of bearing housing and the pump are parallel. Measure with a gauge the clearance between the mating plane of the hearing housings and the pump housing. Having dismantled the bearing assembly, remove the ring and reduce its thickness by the amount of clearance that will allow in final assembling to provide a corrected clearance between the mating planes of the bearing housings and the pump housing close to zero.

Remove temporary spacers from the axial (side) gaps.

Install the pump cover to the pump housing. To do this, having lubricated the contacting surfaces with a liquid gasket (anaerobic sealant-monomer), gently lower the cover of the pump onto the pump housing, install the pins and secure it to the housing, turning the nuts in a few rounds. Make sure that when the lid is lowered projections of the rings were in response grooves of the pump cover. Leave the construction alone for a time sufficient to polymerize the sealant.

Assemble mechanical seals, having installed them so that one of the openings for washing of the mechanical seal was drawn towards the upper opening in the pump cover. Secure the mechanical seal on the pump housing by pins and on the shaft in the axial direction by a single-sided collet clamping device. Disassemble spring clips of mechanical seals.

Install the bearing assembly on the shaft, having pre-set a ring, a sleeve and a compensating ring (not shown). Install between the bearing and the shaft a taper clamping sleeve, tighten the nut by standardized torque and lock it. Tighten the screws by hand and, using the mounting screw, align the pin holes in the bearing housing with the mating holes in the pump housing. Install tapered pins, tighten and lock the screws.

Remove the dummy cover and install the cover in its place. By adjusting gasket thickness ensure the absence of the axial bearing clearance relative to its body.

When installing the support with toroidal roller bearing fit of the flanges of the bearing housing and the pump will be provided by the axial mobility of the roller bearing rings. However, to optimize the conditions of its operation, it is necessary to mate the end face planes of inner and outer rings, which is ensured by adjusting thickness of a compensating ring (not shown). To do this, install and secure the bearing assembly on the pump housing by tightening the screws by hand, set a tapered clamping sleeve into the bearing and tighten the nut. Measure the relative displacement of the outer and inner bearing rings and adjust the thickness of compensating ring against the displacement. Then finally install and secure the bearing assembly.

Check freedom of rotation of the assembled pump.

The assembling of the pump is over. If necessary, bearings and mechanical seals of the rotor shaft may be replaced without disconnecting the cover and the pump housing.

Further is a description of the assembling process of the pump assembly in the following sequence of techniques: mounting of a common frame or individual frames to a foundation, horizontal levelling of their support surfaces at two levels, and finally mounting the frames to the foundation, fitting mounting of the pump and/or electric motor to the frame or individual frames on mounting supports; producing general through holes in the supports, feet and the corresponding mounting surfaces of the frame and presetting of mounting bolts in produced through holes, welded or flanged connection of pump nozzles with pipelines; adjustment and final installation of all mounting supports under the pump and the electric motor, simultaneously using laser for precise alignment of the pump and electric motor shafts; final tightening of the mounting bolts of supports; connection of the pump and electric motor shafts exhibited coaxially aligned and spaced apart from each other by installing a compensating dual disc coupling with the intermediate shaft.

The assembling of the pump assembly is over. If necessary, the sleeve between the shafts can be removed without moving the pump or electric motor.

An example of assessing the benefits of a method for assembling the pump assembly.

Preliminary tests of the pump assembly prototypes and expert evaluation showed the following relative values of impact of the proposed technical solutions, primarily to reduce the vibration of the pump assembly, shown in the table on a separate sheet.

Thus, as a result of all proposed inventive improvements of the pump assembly (its vibration activity and noise are reduced, and resource is increased), its performance will be substantially improved, and hence the main aim of the present invention achieved.

Table of technical solutions to reduce vibration of electric pump assemblies having pumps of type NM 1250 . . . 10000

| Factors influencing vibration parameters | | Technical solution reducing vibration | | | | |
|---|---|---|---|---|---|---|
| | | Non-splined, zero-backlash seating of the impeller on a smooth shaft | Use of roller beaings seated in a non-splined, zero-backlash fashion on the smooth shaft | Use of mechanical seals seated in a non-splined, zero-backlash fashion on the smooth shaft | Use of self-correcting adjustable spherical supports under the supporting feet of the pump | Boring of the seating surfaces of the pump housing for the rotor in a single set-up operation |
| Mecanical | Rotor imbalance | Speed n and 2 n * Reduced by 15-20% | Speed n and 2 n * Reduced by 20-25% | Speed n, 2 n Reduced by 3% | Speed n and 2 n * Reduced by 25-50% | Speed n and 2 n * Reduced by 20-25% |
| | Shaft length and its profile | Speed n and 2 n * Reduced by 5-10% | Speed n and 2 n * Reduced by 20-25% | — | Speed n and 2 n Reduced by 1-3% | Speed n and 2 n * Reduced by 5% |
| | Sliding bearing supports | Speed 0.5 n and n * Reduced by 10-15% | Speed 0.5 n and n * Reduced by 20-25% | — | Speed 0.5 n and n* Reduced by 1-3% | — |
| | Misalignment of pump and drive motor shafts | Speed n and 2 n * Reduced by 5-10% | Speed n and 2 n * Reduced by 10% | — | Speed n and 2 n * Reduced by 25-50% | Speed n and 2 n * Reduced by 10% |
| | Mounting rigidity of the assembly to a frame | Speed 0.5 n and n * Reduced by 3-5% | Speed 0.5 n and n * Reduced by 5-10% | — | Speed n and 2 n * Reduced by 25-50% | Speed n and 2 n * Reduced by 5% |
| Hydrodynamic | Blade vibration | Speed k*n; 2*k*n; 4*k*n Reduced by 10% | Speed k*n; 2*k*n; 4*k*n Reduced by 10% | — | Speed k*n; 2*k*n; 4*k*n Reduced by 5% | Speed k*n; 2*k*n; 4*k*n Reduced by 5% |
| | Operation of the pump in non-design mode | Speed k*n; 2*k*n; 4*k*n Reduced by 5% | Speed k*n; 2*k*n 4*k*n Reduced by 5% | Speed k*n; 2*k*n; 4*k*n Reduced by 3% | Speed k*n; 2*k*n; 4*k*n Reduced by 10-20% | Speed k*n; 2*k*n; 4*k*n Reduced by 5% |

Symbols:
n—rotor speed, Hz (usually 50 Hz = 3000 rev/min)
k—number of impeller blades (in proposed pump k = 7)
factor 2—of availability of keys in conventional versions of mainline oil pump
factor 0.5—of availability of bearings in conventional versions of mainline oil pump

The invention claimed is:

1. An electric pump assembly comprising a horizontal single-stage double-volute pump, an electric drive motor, a coupling connecting the pump and the motor, and a common or separated frames for mounting the pump and motor thereon, the pump comprising:

a housing and a cover with two semi-volute inlets and a double-volute outlet, a rotor consisting of a shaft and an impeller being installed between the housing and the cover, the impeller being seated on the shaft by way of a double-sided collet clamping device having taper sleeves and screws, rotor mechanical seals being seated on the shaft by way of single-sided collet clamping devices having taper sleeves and screws, the double-sided and single-sided collet clamping devices being a combination of coaxial rings with tapered working surfaces with the coaxial rings being slidable by using one or more clamping screws along an axis of the shaft relative to each other to clamp the coaxial rings to the shaft, the rotor being mounted relative to the housing using roller bearings of two types: a double-row spherical roller bearing taking up axial load of the pump shaft, and a floating toroidal roller bearing, wherein the double-row spherical roller bearing and the floating toroidal roller bearing are mounted on the shaft using a pair of tapered adapter sleeves.

2. A pump assembly of claim 1, wherein mounting surfaces for pump feet of the pump are set to the level of a common central axis of a suction nozzle and a discharge nozzle of the pump.

* * * * *